United States Patent [19]

Sturges, Jr.

[11] Patent Number: 4,489,587

[45] Date of Patent: Dec. 25, 1984

[54] VERNIER PRESS BRAKE DIE SET

[75] Inventor: Robert H. Sturges, Jr., Pittsburgh, Pa.

[73] Assignee: Westinghouse Electric Corp., Pittsburgh, Pa.

[21] Appl. No.: 474,935

[22] Filed: Mar. 14, 1983

[51] Int. Cl.[3] ..... B21D 5/01

[52] U.S. Cl. ..... 72/389; 72/319; 72/463

[58] Field of Search ..... 72/319, 320, 389, 462, 72/463, 470, 474, 475, 476, 34

[56] References Cited

U.S. PATENT DOCUMENTS

| | | | |
|---|---|---|---|
| 3,350,912 | 11/1967 | Smith, Jr. | 72/319 |
| 3,948,074 | 4/1976 | Stalzer | 72/319 |
| 4,191,043 | 3/1980 | Schaffer | 72/319 |
| 4,203,379 | 5/1980 | Lambertson | 72/389 |

FOREIGN PATENT DOCUMENTS

| | | | |
|---|---|---|---|
| 640405 | 4/1962 | Canada | 72/319 |

*Primary Examiner*—Lowell A. Larson
*Attorney, Agent, or Firm*—T. R. Trempus

[57] ABSTRACT

A die for the manufacture of tray like sections has a member with a plurality of slots arranged to accommodate a variety of required gap dimensions. The slots are arranged in a pattern which consists of two sections each of which extends from a common datum in opposite directions along the length of the die. The first or integer section is of arbitrary length and contains slots spaced equally apart from each other a convenient value or metric. The distance between the right edge of the slot and the datum is equal to the metric value.

The second section or vernier section contains slots with a different spacing pattern depending on the degree of precision required of the vernier. These slots are spaced incrementally from the datum by a value equal to a multiple of the metric plus a fractional value of the metric. This arrangement permits the accommodation of various tray sizes larger than a minimum size as dictated by die design. In operation, after two opposed side walls of a tray are formed, the outside dimension of the side wall is measured and the fractional part of the measurement used to determine the particular vernier slot to be used. With the correct vernier slot chosen for one side wall, a slot in the integer section automatically lines up with the other tray side wall.

5 Claims, 3 Drawing Figures

VERNIER PRESS BRAKE DIE SET

BACKGROUND OF THE INVENTION

The invention is directed to the manufacture of sheet metal shapes, particularly shapes which have two or more sections thereof disposed at right angles relative to each other. The manufacture of sheet metal often involves the bending of a metal sheet into tray-like sections having a bottom member and four upwardly extending side members disposed at right angles to the bottom member and each other. A press brake die is commonly used to shape such a tray-like member. The first set of opposing side members can be formed in the sheet metal without regard to the use of a die having a length which exceeds the length of the metal sheet. The formation of the second set of opposed side members, however, requires that the upper die, the die toward which the metal sheet is bent, be modified to accommodate the presence of the first set of opposed side members.

The modification of the upper die can be accomplished in several ways. The usual shop practices involve the removal of the long upper die and replacing it with a single shorter upper die or several shorter dies with a total length equal to or smaller than the inside dimension of the first set of opposed walls. It is also known to employ an upper die with at least one gap formed therein which is aligned to accommodate one of the side members of the first opposing set. An example of an upper die with such a gap is disclosed in U.S. Pat. No. 4,203,379. In each of the above described methods for forming the second set of opposing side members, the press brake die must undergo a set-up operation which requires the handling of a set of dies for each size panel to be manufactured. The existing methods have several obvious drawbacks such as excessive handling of die sets which causes both lost time and money. Moreover, for short run jobs in which only one or two pieces are to be manufactured, the die set-up time can often exceed the time required to effect the bending of the sheet metal by the die.

SUMMARY OF THE INVENTION

A bending apparatus such as a press brake die set has an upper member and a lower member disposed to receive the upper member therein. A sheet of bendable material, such as metal is positioned between the upper and lower members in order to be bent to a desired form when the upper member is received by the lower member. In a press brake die set according to this invention, the upper die has a plurality of slots disposed therein to define an integer section and a vernier section. In the integer section, the slots are arranged so that each slot is separated from the adjacent slot by a distance equal to a predetermined metric. The slots in the vernier section are separated from each other a distance equal to a multiple of the metric plus a fraction of the metric from a datum point or slot on the scale. The slot width is preferably equal to the sum of the metric fraction plus the maximum expected thickness of the metal to be bent by the die set. This arrangement of slots in an integer and vernier scale permits the accommodation of a wide range of sizes in the bending of sheets into tray-like sections where all four sides are bent at right angles to the sheet surface. The present invention provides the clearances necessary for the bending of the third and fourth sides after the first and second sides are completed.

BRIEF DESCRIPTION OF THE DRAWINGS

The above as well as other features and advantages of this invention will become apparent through consideration of the detailed description in connection with the accompanying drawings in which.

DETAILED DESCRIPTION OF THE INVENTION

Figure 1:
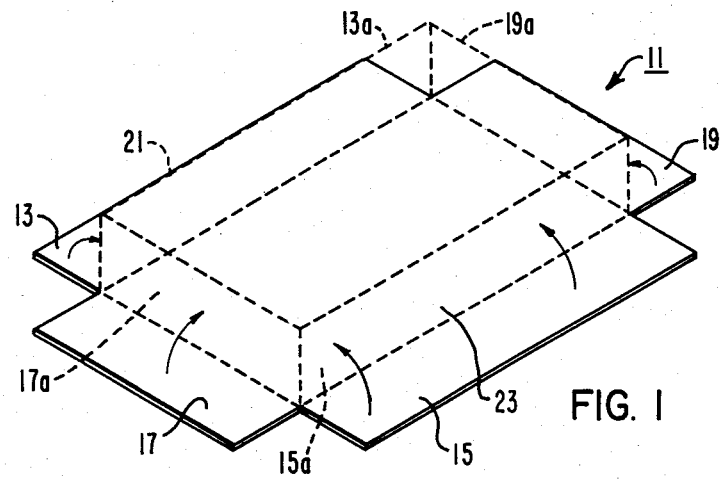
FIG. 1 is an isometric view of a section of sheet metal prepared for bending into a tray-like device which is shown in dash dot line.

The vernier press brake die set of this invention is an integral, fixed die set which permits the bending of tray-like parts of varying dimensions without changing or adjusting the die parts. In FIG. 1, a section of sheet metal prepared for bending into a tray-like device is generally indicated by the reference character 11. Prior to bending, the sheet meta 11 is typically a planar member which includes a first pair of opposing side walls 13 and 15, and a second pair of opposing side walls 17 and 19.

The sheet metal planar member with integral side walls is typically cut or stamped from a section of sheet metal. The tray-like device into which the sheet metal is bent is shown in dash dot line and indicated by the reference character 21. The tray 21 has four side wall members 13*a*, 15*a*, 17*a* and 19*a* which are disposed approximately 90° to the bottom 23 of the tray 21 and approximately 90° to each other.

In the manufacture of such a tray 21, the first pair of opposing side walls 13 and 15 can be bent in a press brake die without regard to the fact that the length of the die may exceed the longitudinal dimension of the sheet metal 11 along the line of the band. The product at this stage in the manufacture of the tray 21 is shown in cross section in FIG. 2 and indicated by the reference character 21*a*. While effecting the bending of the first pair of opposed side walls 13*a* and 15*a* presents no significant difficulty, the bending of the second pair of opposed sides 17 and 19 requires clearance gaps in the die toward which the metal is being bent to allow for the raised edges of the first two side walls 13 and 15. In order to accommodate reverse bend parts, it may be necessary to provides slots in both dies.

Figure 2:
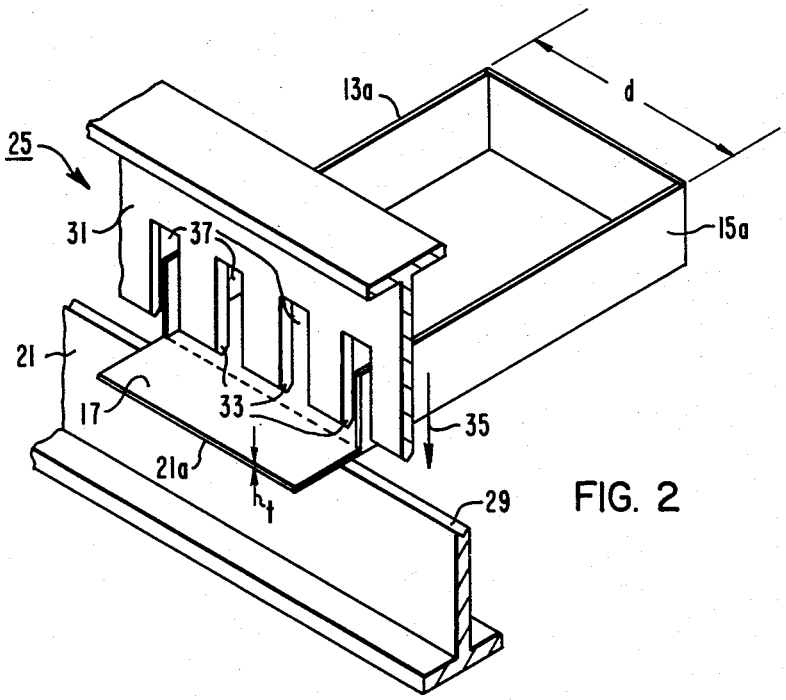
FIG. 2 is an isometric view of a portion of a vernier press brake die set illustrating the teachings of this invention.
Figure 3:
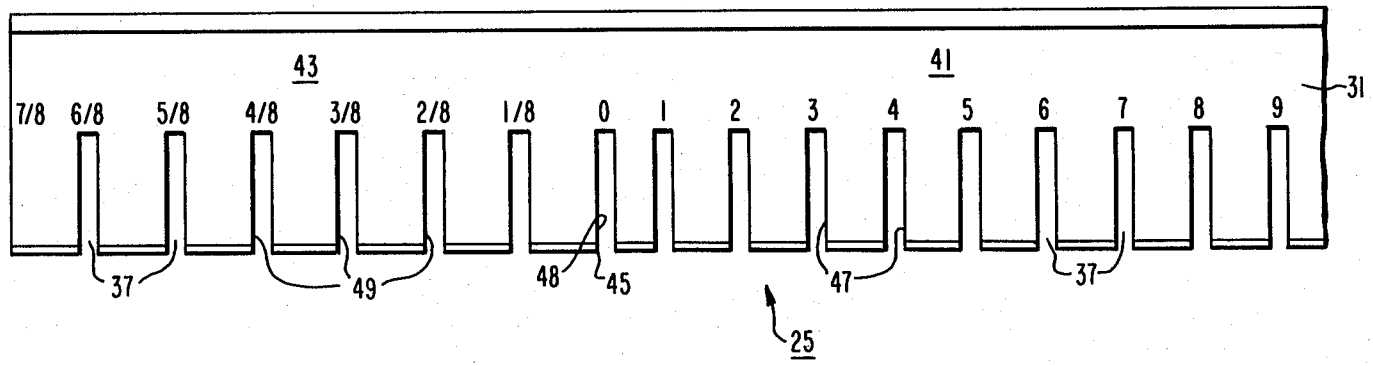
FIG. 3 is a somewhat schematical representation of one member of a press brake die all according to the teachings of this invention.

A vernier press brake die set according to the teachings of this invention is illustrated in FIGS. 2 and 3, and generally indicated by the reference character 25. The die set 25 includes a lower die 27 having a generally "V" shaped surface 29 and an upper die 31 which has an outer surface 33 shaped to produce a desired inner surface between the bottom 23 and each side wall of the tray. As shown in FIG. 2, the upper die outer surface 33 is generally angular in cross-section. As the upper die 31 moves downwardly in the direction indicated by the block arrow 35, it engages the metal sheet and presses the side wall to the desired upright position. The die set 25 can be mounted in any of a variety of presses known in the art in order to effect the pressing action described above. Additionally, various combinations of bending surfaces in the upper and lower dies can be employed according to the required pressing application.

In FIG. 2, the upper die 31 has a plurality of slots 37 disposed therein according to a predetermined alignment. As a result of this alignment, the slots 37 can accommodate any required gap dimension above a certain minimum gap and various gap dimensions below this minimum. The slot pattern can be fully appreciated with reference to FIG. 3. The predetermined alignment or slot pattern consists of two sections, an integer section 41 and a vernier section 43 extending in opposite directions from a datum point 45.

The integer section 41 is shown to extend to the right of the datum point 45 for illustrative purposes only. It is equally convenient to locate the integer section to the left of the datum point and the vernier section to the right. The datum point 45 is defined by a predetermined edge of a slot 37 located at a point in the upper die 31, which point is dictated by the ultimate use of the die. In other words, the range of tray sizes which are to be accommodated by a single die serves as an important design criterion in determining the overall length of the die.

The datum point 45 is on the upper die 31 and is defined by the left edge 47 of the datum slot. Progressing to the right along the integer section 41, a plurality of slots 37 are spaced equally apart from each other with the exception of the first slot from the datum point. In order to simplify the description of the integer section and the operation of the present invention, a scale is disposed along the length of the die 31. Such a scale is particularly useful along the vernier section 43, and in the practice of this invention might only be provided on that portion of the die. The distance between the slots of the integer section is equal to a convenient predetermined value or metric, which is selected for this die configuration to be equal to one inch. The distance from the right edge 47 of integer slot '1' to the right edge 47 of integer slot '2' is one inch. However, the distance from the left edge 48 of the datum slot 45 to the right edge 47 of integer slot '1' is equal to the predetermined value metric. As will be explained more fully below, the slot width is a combination of the maximum expected thickness of the metal sheet to be manipulated by the die and the metric fraction. Accordingly, the distance from the right edge, or any given point, of a slot in the integer section to a corresponding point on the next following or immediately preceding slot, with the exception of the datum slot, equals the predetermined metric.

The vernier section 43 extends from the datum point 45 in a direction opposite the integer section 41. As shown in FIG. 3, the vernier section extends to the left of datum. The slots 37 along the vernier section of the upper die 31 are arranged according to a spacing pattern which depends on the degree of precision required of the vernier. For illustrative purposes, $\frac{1}{8}$ of the metric will be used to demonstrate the vernier slot alignment of this invention. Thus, the left edge 49 of the first slot of the vernier section is spaced from the left edge 48 of the datum slot 45 a distance equal to the metric plus the metric fraction, $1\frac{1}{8}$ inch. The first vernier slot is marked on the scale to indicate its metric fraction value: $\frac{1}{8}$ inch. Each succeeding vernier slot is spaced incrementally from the datum by a multiple of the metric plus metric fraction, i.e.,; $2(1\frac{1}{8})$, $3(1\frac{1}{8})$, $4(1\frac{1}{8})$. . . $7(1\frac{1}{8})$. The scale above the vernier slots reflects the multiple of the metric fraction, i.e.,; 2/8, $\frac{3}{8}$, 4/8 . . . $\frac{7}{8}$. Following this incremental pattern, the left edge 49 of the second vernier slot 2/8, is 2 2/8 inches distance to the left of the datum and the left edge 49 of the third slot $\frac{3}{8}$ is $3\frac{3}{8}$ inches distance from datum. This pattern continues until the largest metric fraction short of a whole number is reached, in this case $\frac{7}{8}$. The last vernier slot, the $\frac{7}{8}$ slot may be the end of the die, rather than an actual slot formed therein.

The slot width is a predetermined value based upon the metric fraction (1/f) plus the maximum expected sheet metal thickness. Throughout the illustrations, a maximum sheet metal thickness 't' (FIG. 2) of $\frac{1}{8}$ inch is assumed. As a result, the selected slot width for the present example suggests a value of $\frac{1}{4}$ inch.

The vernier press brake die set 25 accommodates a metal tray sized within a range which is determined by several factors. The maximum limit of the tray size range is dictated by the actual length of the upper die. With a die having an integer section of 12 inches in length and a vernier section of $7\frac{7}{8}$ inches in length, a maximum tray size of $19\frac{7}{8}$ can be accommodated. The minimum limit which can be accommodated in general is approximately the reciprocal of the metric fraction, in this case 8 units, reduced by the slot width and the material thickness of the sheet metal employed. In addition to the range established by the maximum-minimum limits, several separate tray dimensions which are smaller than the minimum limit can be accommodated.

The operation of the vernier press brake die set can be appreciated with reference to FIGS. 2 and 3. For a given bend, the outside dimension 'd' of the first pair of opposing side walls 13*a* and 15*a* is determined. For this example 'd' equals $8\frac{5}{8}$ inches. The whole number portion of the measurement is discarded, thus $\frac{5}{8}$ inch becomes the operative dimension. The partially completed tray is positioned so that one side wall 13*a* of the first pair of opposing side walls rests in the slot in the vernier section marked $\frac{5}{8}$ inch. The other side wall 15*a* automatically lines up with a slot in the integer section, in this case, the third slot from the datum slot in the integer section of the die.

What has been described is a vernier press brake die set in which the upper die is provided with two sections of slots, one section spaced in even increments, the other section having identical slots spaced fractionally farther apart to create a vernier. While one particular application of the principles of this invention has been described, this slot arrangement can be profitably used in a variety of bender apparatus such as a wing bender or a wiping die bender.

What is claimed is:

1. A bending apparatus comprising a first member and a second member disposed to receive said first member therein such that a sheet of bendable material disposed therebetween is bent to a desired form when said first member is received by said second member, at least one of said members having an integer section and a vernier section extending in opposite directions along the sheet material contacting edge of said member, said integer section having a plurality of slots along said edge, spaced a predetermined metric distance apart and said vernier section having a plurality of slots along said edge, incrementally spaced from a datum a distance corresponding to a multiple of the sum of said predetermined metric distance plus a selected fraction of said distance, each of said slots having a predetermined width which is equal to the sum of the selected metric fraction plus the thickness of the bendable material.

2. The bending apparatus according to claim 1 wherein each slot in the vernier section and the integer section has a left and right edge and wherein the distance from the datum to the right edge of the next following slot of the integer section equals the predetermined metric.

3. The bending apparatus according to claim 2 wherein the incremental spacing of the initial vernier slot from the datum, which spacing is equal to the metric plus a selected fraction thereof, is measured from the datum to the left edge of the initial vernier slot.

4. The bending apparatus according to claim 3 wherein the datum is defined by the left edge of a slot disposed in the sheet metal contacting edge of the member.

5. The bending apparatus according to claim 1 wherein the first and the second member each include integer and vernier sections having a plurality of slots therein disposed along the metal contacting edge of both said first and said second members..

* * * * *